United States Patent [19]

Ponchaux

[11] 4,270,439

[45] Jun. 2, 1981

[54] FLUID ROTARY MACHINE

[76] Inventor: Jean-Luc Ponchaux, La Cure de Pétosse, 87550 L'Hermenault (Vendée), France

[21] Appl. No.: 917,569

[22] Filed: Jun. 21, 1978

[30] Foreign Application Priority Data

Jun. 24, 1977 [FR] France ..... 77 19378
Jun. 27, 1977 [CA] Canada ..... 281419

[51] Int. Cl.[3] ..... F01B 1/04
[52] U.S. Cl. ..... 91/495; 417/273
[58] Field of Search ..... 417/273; 91/491–496

[56] References Cited

U.S. PATENT DOCUMENTS

| | | | |
|---|---|---|---|
| 2,341,196 | 2/1944 | Svenson | 417/273 |
| 2,345,125 | 3/1944 | Huber | 417/273 |
| 2,553,063 | 5/1951 | Simpson et al. | 91/492 |
| 2,952,219 | 9/1960 | Woydt | 91/481 |
| 2,967,490 | 1/1961 | Von Soden | 91/495 |
| 3,744,380 | 7/1973 | Steiger | 91/488 |
| 4,018,139 | 4/1977 | Landreau | 91/490 |

FOREIGN PATENT DOCUMENTS

| | | | |
|---|---|---|---|
| 857594 | 9/1940 | France | 417/221 |
| 2355992 | 1/1978 | France | 91/488 |
| 264604 | 1/1927 | United Kingdom | 417/273 |

*Primary Examiner*—William L. Freeh
*Attorney, Agent, or Firm*—Schwartz, Jeffery, Schwaab, Mack, Blumenthal & Koch

[57] ABSTRACT

There is a fluid rotary machine having radial pistons and a shaft with an eccentric cam having a rotational movement relative to the housing. The cam mounts a ring on the exterior thereof and the pistons abut against the exterior surface of the ring with each piston mounted for sliding movement in the interior of the cylinder. The ring is associated with the distribution of the fluid of the machine to the pistons and cylinders. Means are provided to immobilize the ring against rotation relative to the housing and subjugate the ring to an essentially circular translation movement relative to the rotational movement of the eccentric cam on which the ring is mounted, and is characterized by the fact that the means for maintaining the ring in such a position comprises a plurality of elastic members connecting predetermined points of the ring to anchor points unassociated with the ring. These elastic members are sufficiently strong to oppose the tendency of the ring to rotate with the cam, but on the other hand, have sufficient elasticity to be adaptable to different eccentricities of the cam when the actual displacement of the machine is being changed.

2 Claims, 4 Drawing Figures

FLUID ROTARY MACHINE

BACKGROUND OF THE INVENTION

1. Field of the Invention

The present invention relates to a rotary machine, and more particularly, to a radial piston machine utilizing fluids under pressure.

2. Description of the Prior Art

In my United States application Ser. No. 809,914, filed June 24, 1977, there is described a radial piston engine utilizing fluid under pressure, wherein the pistons are mounted in cylinders, subject to oscillating movement, and a cam shaft mounts an eccentric cam having a rotary movement relative to the housing.

In accordance with a specific embodiment described in the U.S. patent application Ser. No. 809,914, the pistons abut against the eccentric cam by the intermediary of an annular ring journaled on the cam, and the annular ring is subject to follow a circular translation movement with respect to the housing in relation to the rotary movement of the shaft relative to the housing. The amplitude of the circular translation movement is essentially equal to twice the displacement of the eccentric cam off-center. This non-rotational circular translation movement of the annular ring is maintained by means of rotary members connected to the housing and to the annular ring. These members have a certain elasticity in order to compensate for the differences in the actual distances between their axes resulting from the tolerances of manufacture of the different parts.

However, even though such members or cranks or swivels have certain elasticity, the geometry of these members is adapted to each value of the eccentricity of the cam.

If it is desired to modify the eccentricity of the cam, for example, in order to modify the displacement of the cylinders of the machine and thereby obtain a completely new engine with a different cubic capacity while maximizing the number of common parts used in the engine, it will be necessary to provide new retaining means to control the ring which should be a function of the change in the difference in the crank axes caused by the change in the eccentricity of the cam.

It can be seen, therefore, that due to the weak elasticity of the known anchor or crank means for providing the circular translation movement to the ring, these are poorly adapted, in the case of a radial piston machine having an interior cam and a variable cubic capacity by controlling the variation of the eccentricity of the cam.

SUMMARY OF THE INVENTION

The present invention aims to provide new, more flexible, anchor means which retains the ring relative to the housing and provides its circular translation movement relative to the cam, and such means being more adapted to different values of eccentricity of the cam.

The present invention relates to a fluid rotary machine having radial pistons and a shaft with an eccentric cam having a rotational movement relative to the housing. The cam mounts a ring on the exterior thereof and the pistons abut against the exterior surface of the ring with each piston mounted for sliding movement in the interior of the cylinder. The ring is associated with the distribution of the fluid of the machine to the pistons and cylinders. Means to immobilize the ring against rotation relative to the housing and subjugate the ring to an essentially circular translation movement relative to the rotational movement of the eccentric cam on which the ring is mounted, is characterized by the fact that the means for maintaining the ring in such a position comprises a plurality of elastic members connecting predetermined points of the ring to anchor points unassociated with the ring. These elastic members are sufficiently strong to oppose the tendency of the ring to rotate with the cam, but on the other hand, have sufficient elasticity to be adaptable to different eccentricities of the cam when the actual displacement of the machine is being changed.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 4:
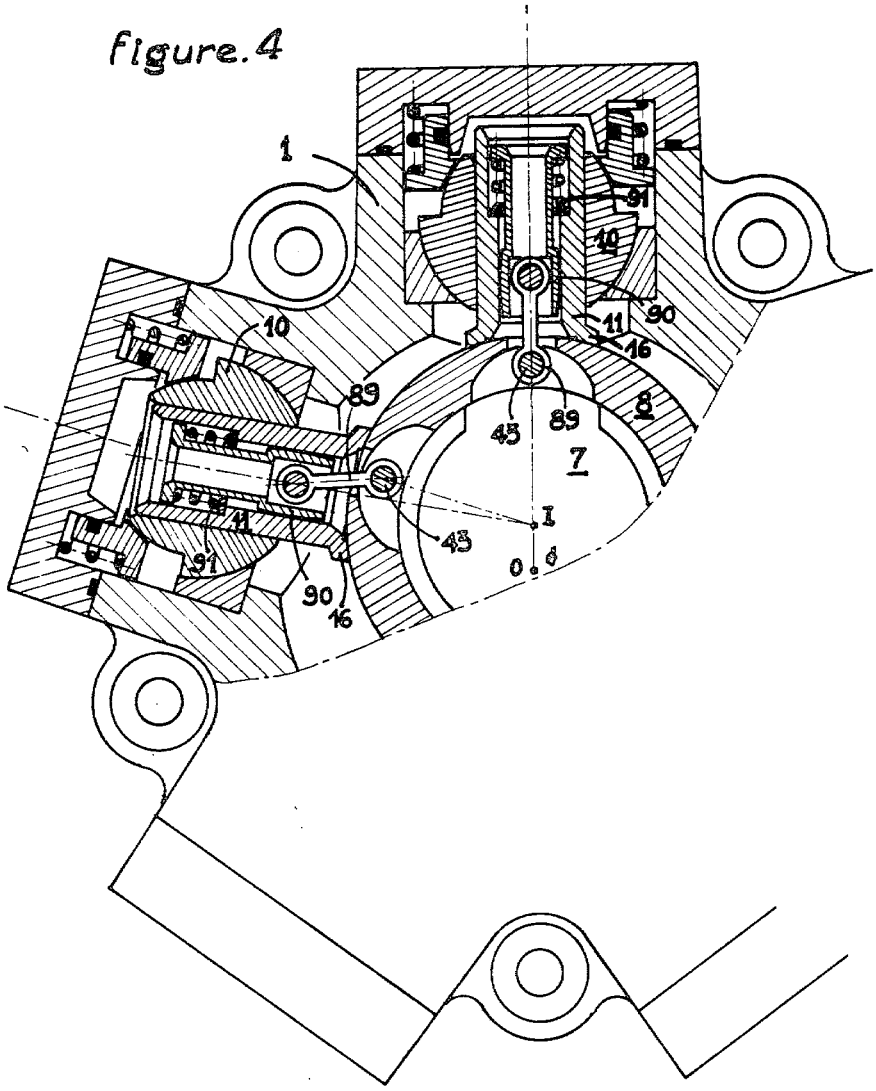
FIG. 4 is a fragmentary radial cross-sectional view of a typical machine, in this case, a radial piston hydraulic motor.

As shown in FIG. 4, the hydraulic motor includes a rotating shaft in a housing 1. The shaft includes an eccentric cam portion 7. An annular ring 8 having a cylindrical bore fits on the cylindrical eccentric 7 and is concentric with the eccentric cam. The outer surface of the ring 8 has a spherical shape. The housing 1 has a number of radially extending bores at right angles to the axis of the rotation shaft, and in FIG. 4 two of these bores are illustrated. In each of these cavities or bores, there is an arrangement of parts including a cylinder 10 having a spherical exterior surface, and in this case, a two-stage spherical surface, that is, where the surface has a different diameter. The cylinder 10 has a central cylindrical bore which is adapted to receive in sliding relation a tubular piston 11.

Each piston 11 includes a base part having a shoe 16 defined with a concave undersurface of spherical curvature matching with a convex spherical surface of the ring 8.

The insufficiency of the various means for providing the circular translation movement, such as a crank connected to the ring 8 and the housing 1, is illustrated when the eccentricity of the cam 7 on shaft 2 is changed. The conventional elasticity of these anchor or crank means is insufficient to permit them to follow the variations in eccentricity of the cam 7.

As will be seen from the description of the preferred embodiments, means for providing the circular translation movement to the ring 8, will adapt to the different values of eccentricity which are possible with the cam 7 within a predetermined range of variation.

Figure 1:
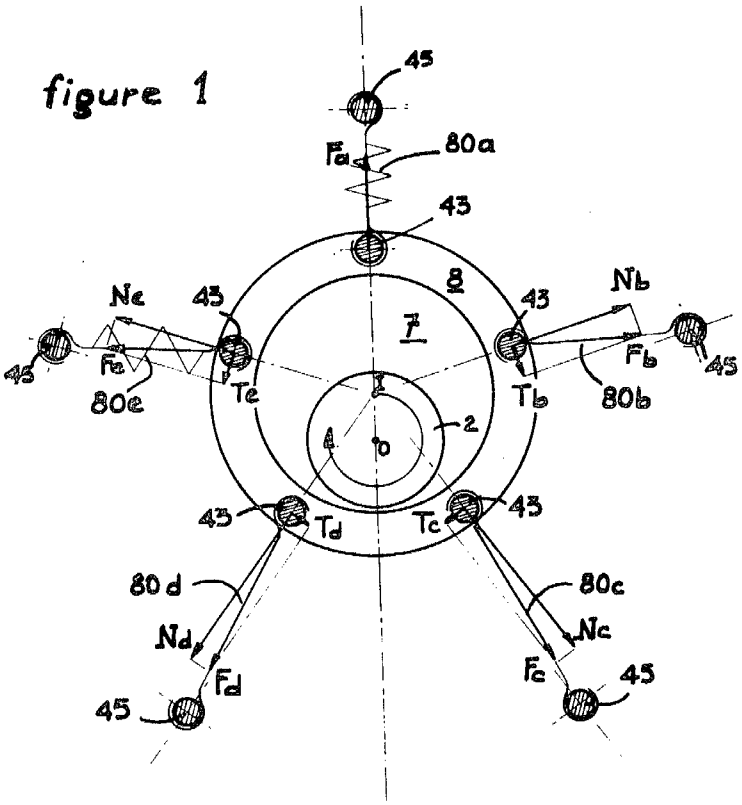
FIG. 1 is a schematic illustration showing diagrammatically the mechanical principles of the present invention.

Referring now to FIG. 1, the ring 8 is shown on a cam 7 which in turn is illustrated in relation to the shaft 2 which supports the cam 7. The point O indicates the axis of the shaft 2, and the point I is the axis of the cam 7. There are in this embodiment five springs 80*a* to 80*e* which are connected at one end to pins 43 on the ring 8, and at the other end to pins 45 fixed to the housing 1.

In the present description, it is noted that the five springs are identical, and the five anchor points 43 on the ring 8 are spaced apart equidistantly and form a concentric circle with the axis of the ring 8 or cam 7. The spring 80*a* in the embodiment shown is in line with the axes I and O, and in accordance with this embodiment, the spring would be in its position of minimum elongation.

It has also been shown in the schematic drawing of FIG. 1 a position of angular static equilibrium of the ring 8 in the light of the symmetry of the forces applied to the ring by the different springs with respect to the straight line through the axes O and I. Another position of static angular equilibrium is attained when the shaft 2 has passed through a half rotation with respect of the housing 1, that is, when the center I of the cam 7 is directly below the center O of the shaft 2. This is also true for the other springs 80*b* to 80*e*, and unless there are other forces than those of the springs acting on the ring, it can be said that a position of static angular equilibrium is reached each time the points 43 and 45 are in direct alignment with the centers O and I as the shaft 2 rotates relative to the housing 1. It can thus be said that a system of the type described which includes n springs will be in a position of static angular equilibrium 2n times for complete rotation of the shaft 2.

It goes without saying that if one changes the tension springs of FIG. 1 by compression springs, the same would apply. The system thus would conserve its characteristics no matter what the eccentricity of the cam 7 would be conditional of course, on the amount of flexion admissible by the springs which would be compatible with the maximum eccentricity chosen for the cam 7. If this system is applied to a machine of the type shown in FIG. 4 in which the ring 8 also serves as a distributor, or is associated with a planar distributor having a circular translation movement, one would dispose the springs 80*a* to 80*e* of the ring 8 such that a point of static angular equilibrium is reached each time the pistons 11 of the machine pass through a position of dead center that is in line with the axis of the cam and the center of the shaft which necessarily corresponds to the commutation phase of the distribution to the piston and the cylinder concerned. It, therefore, would result that it would be desirable to have, about the ring 8, a number of springs 80 equal to the number of cylinders in the machine or a multiple of this number, and to synchronize the deflection of each spring with the stroke of its corresponding piston. Besides the phases of commutation of the distribution which correspond to the static angular equilibrium position of the ring 8, the ring, in response to the force of the springs 80*a* to 80*e*, might take a different angular position than that which would be imposed on it by fixed crank devices of the type described in U.S. application Ser. No. 809,914 without affecting the proper function of the machine. In other words, the translational movement of the ring 8 can be other than a circular translation described in the above United States application without affecting the proper functioning of the machine as long as the translation movement meets the circular translation at each instant of commutation of the distribution of one of the cylinders.

Reference will now be made to an analysis of the forces applied to the ring 8 by the springs 80*a* to 80*e* during a complete rotation of the shaft 2 relative to the housing 1. For this analysis, reference is made to FIG. 1 in which the various components have been illustrated for each of the springs according to a component at right angles or normal to the axis of the ring 8 denoted by the letter N, and a tangential component T at this ring. If the component applied by the spring 80*a* is normal to the ring, the tangential component will be nil.

While the shaft 2 rotates with respect to the housing 1 represented in FIG. 1 by the rotation of point I about point O in the direction of the arrow, the eccentric cam 7 of the shaft 2 has a tendency to rotate the ring 8 in the light of the friction between these two elements. Since in the present embodiment the springs are tension springs, this tendency to rotate of the ring 8 provokes an increase in the elongation of the springs 80*a*, 80*d* and 80*e*; thus an increase in the tangential component applied by the springs to the ring 8, and on the other hand, a reduction in the elongation of the springs 80*b* and 80*c*, and, therefore, a reduction in the tangential component tending to carry the ring 8 in rotation in the same direction as the shaft 2. One can, therefore, see that the totality of the springs anchored to the ring 8 is in opposition to the rotation of the ring by the cam 7 of the shaft 2. It is evident that the system will act in the same manner if the rotation of the shaft is reversed relative to the housing 1.

In conclusion, it suffices to find the best possible position to anchor the spring relative to the housing, associated with the proper flexibility and strength of the springs such that the distribution of the fluid, particularly at the communication phase of the distribution is assured in all of the different phases of the machine. In other words, the optimization of the elastic system controlling the ring 8 consists in finding the right compromise between the tangential resistance of the system opposing the rotational momentum of the ring 8 by the cam 7 on the shaft 2 in the normal function of the machine defined by the particular friction conditions relative to the ring 8 and the cam 7 and its flexibility permitting the springs to be adapted to the maximum eccentricity of the cam 7.

It goes without saying that all of the above discussion is valid even though the tension springs 80 may be replaced by compression springs, but, of course, the force components would be reversed.

Figure 2:
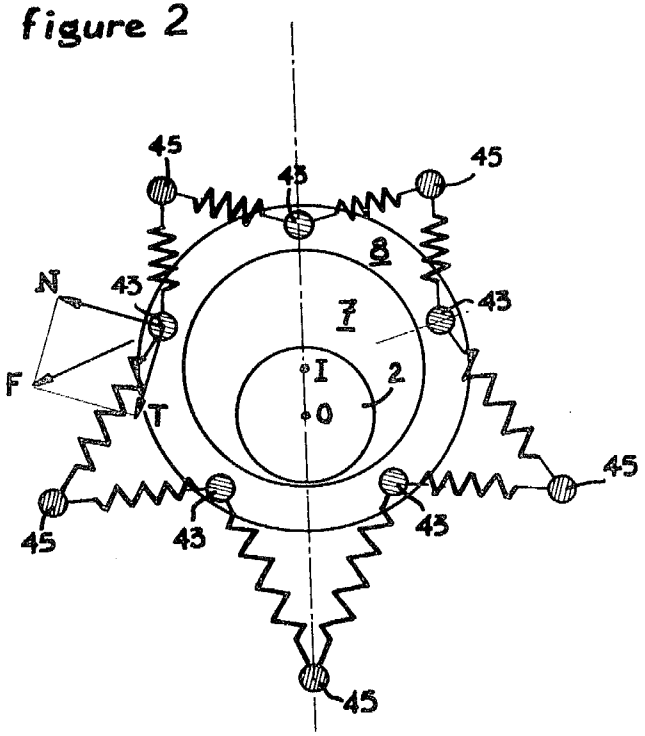
FIG. 2 is a similar schematic illustration showing a specific embodiment of the present invention.

In FIG. 2, a different embodiment is illustrated in which the tangential force components have been increased as applied to the ring 8 and the number of springs has been doubled whereby the rotation of the shaft 2 can be in one direction or the other without affecting the system. The system shown in FIG. 2 has the advantage over the embodiment in FIG. 1 of allowing greater flexibility of the springs and thus weaker springs can be used.

Figure 3:
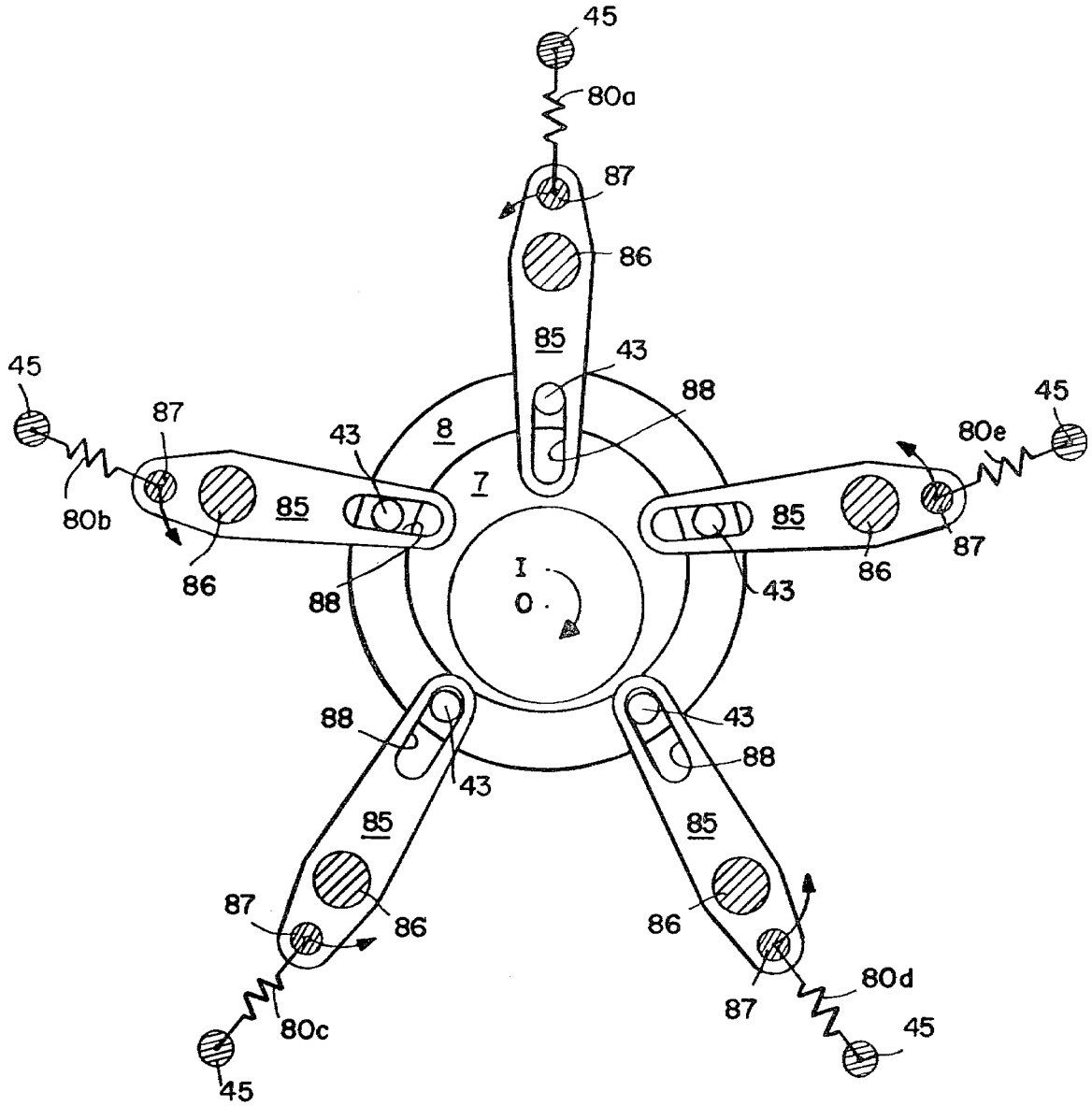
FIG. 3 is an enlarged fragmentary detailed view of a particular retaining means in accordance with the present invention.

In FIGS. 3 and 4, other variations are shown illustrating this invention.

According to the embodiment in FIG. 3, a lever 85 is provided connected to the spring 80 (similar to FIG. 1) and which is pivotable around a pin 86 affixed to the housing 1. The spring 80 is anchored to a pin 87 provided on the lever while the other end of the spring 80 is anchored to the pin 45 fixed to the housing. The other end of the lever is provided with a slot 88 in which a pin 43 is adapted to slide. Of course, the pin 43 is fixed to the ring 8. The slot 88 is determined by the maximum variation of eccentricity of the cam 7 on the shaft 2. While the shaft 2 rotates with respect to the housing 1, the elongation of the spring 80 is much reduced since its deflection is only determined by the angularity of the lever arm which is the distance between the pins 86 and 87, but the overall advantages of the system described earlier is maintained.

In FIG. 4, there is shown still another embodiment. According to this embodiment, each pin or axis 43 connected to the ring 8 is journaled to a member 89 connected to the interior of the piston 11, that is, to a sleeve 90 within the piston 11, and the sleeve 90 is adapted to slide axially relative to the piston 11.

The upper part of the sleeve compresses a spring 91 which abuts against a shoulder provided in the bore of the piston 11, forcing, therefore, the shoe 16 of the piston 11 against the outer surface of the ring 8.

As in the system shown in FIG. 1, FIG. 4 shows the representation of one of the assemblies, including the rod member 89, sleeve 90, piston 11, and spring 91 in alignment with the centers O and I representing respectively the axis of the shaft 2 and of the cam 7. This position represents the top dead center of the piston 11 and the commutation phase of the distribution for the corresponding cylinder. Simultaneously, the other cylinder assemblies 10 with pistons 11 have taken a certain angle of inclination with respect to the housing 1 and, therefore, each member 89 is at an angle with respect to the piston 11 to which it corresponds, thus compressing against the spring 91 by means of the sleeve 90 sliding in the interior of the piston 11.

The result is that there is a symmetry similar to FIG. 1 in so far as all of the springs 91 are identical. One can deduce from this configuration and in the absence of other forces than those caused by the springs, that the ring 8 will be found to be in a position of static angular equilibrium which guarantees the synchronization of the commutation of the distribution of the fluid with the top dead center of the piston.

This state of equilibrium in rotation of the ring can also be found at the low dead center of the piston, and this is valid for each piston in the machine. As to the stroke of compression of the spring 91, it is equal to the deflection of the arc described by the articulation of the member 89 with the sleeve 90 in its partial rotation centered on axis 43. This stroke is a function of the geometry of the different pieces of this system, and in particular, of the distance between the axis of the member 89, and is practically very small compared to the maximum eccentricity of the cam 7 on the shaft 2.

While the machine is functioning, that is, when the shaft 2 turns with respect to the housing 1 and the cam tends to rotate the ring 8, as in the case of FIG. 1, a dissymmetry of the force components applied by the springs 91 is witnessed which tends to retain the ring 8 in its initial position. According to this embodiment, the springs 91 are not, strictly speaking, anchored to the housing 1 or to a fixed member relative to the housing but to the pistons 11, and thus the tension force on the member 89 is transmitted to the contact of the piston 11 with the cylinder 10. However, practically speaking, this is a very weak or small resultant force which has no apparent effect on the parts.

On the other hand, the spring 91 also serves to guarantee the contact of the piston 11, that is, the shoe 16 of piston 11, with the exterior surface of the ring 8 and thus ensures the seal between these two parts. The contact force which is imposed to the two pieces can, however, be without serious consequences since it suffices to compensate by increasing the pressure field under the shoe 16 of the piston 11.

I claim:

1. A fluid rotary machine having radial pistons and a shaft with an eccentric cam having a rotational movement relative to the housing, the cam mounting a ring on the exterior thereof and the pistons abutting against the exterior surface of the ring with each piston mounted for sliding movement in the interior of a cylinder, the ring being associated with the distribution of the fluid of the machine to the pistons and cylinders, means immobilizing the ring against rotation relative to the housing and subjugating the ring to an essentially circular translation movement relative to the rotational movement of the eccentric cam on which the ring is mounted, characterized by the fact that the means for maintaining the ring in such a position comprises a plurality of elastic members connecting predetermined points of the ring to anchor points unassociated with the ring, these elastic members being sufficiently strong to oppose the tendency of the ring to rotate with the cam, but on the other hand, having sufficient elasticity to be adaptable to different eccentricities of the cam when the actual displacement of the machine is being changed, said elastic members being such that their flexion is only a fraction of the value of the eccentricity of the cam, characterized by the fact that, between each spring anchored to the housing and the ring, there is provided a rotary lever having asymmetric arms and the fulcrum of which is fixed relative to the housing, one of the arms being connected to the spring and the other being slidably connected to the pivot axis of the ring.

2. A fluid rotary machine having radial pistons and a shaft with an eccentric cam having a rotational movement relative to the housing, the cam mounting a ring on the exterior thereof and the pistons abutting against the exterior surface of the ring with each piston mounted for sliding movement in the interior of a cylinder, the ring being associated with the distribution of the fluid of the machine to the pistons and cylinders, means immobilizing the ring against rotation relative to the housing and subjugating the ring to an essentially circular translation movement relative to the rotational movement of the eccentric cam on which the ring is mounted, characterized by the fact that the means for maintaining the ring in such a position comprises a plurality of elastic members connecting predetermined points of the ring to anchor points unassociated with the ring, these elastic members being sufficiently strong to oppose the tendency of the ring to rotate with the cam, but on the other hand, having sufficient elasticity to be adaptable to different eccentricities of the cam when the actual displacement of the machine is being changed, said elastic members being such that their flexion is only a fraction of the value of the eccentricity of the cam, characterized in that the elastic members are in equal number to the number of pistons and are each situated within a respective piston assuring an elastic connection between the ring and each of the pistons.

* * * * *